United States Patent [19]

Elenbaas

[11] Patent Number: 4,797,519

[45] Date of Patent: Jan. 10, 1989

[54] MERCURY TILT SWITCH AND METHOD OF MANUFACTURE

[76] Inventor: George H. Elenbaas, 25526 N. Shore Dr., Elkhart, Ind. 46514

[21] Appl. No.: 40,213

[22] Filed: Apr. 17, 1987

[51] Int. Cl.[4] ..... H01H 29/04

[52] U.S. Cl. ..... 200/226; 200/222; 200/227; 200/231

[58] Field of Search ..... 200/220, 221, 222, 226, 200/227, 228, 229, 231

[56] References Cited

U.S. PATENT DOCUMENTS

| | | | |
|---|---|---|---|
| 2,033,372 | 3/1936 | Bear et al. | 200/228 |
| 2,182,216 | 12/1939 | Staley . | |
| 2,282,512 | 5/1942 | Bucklen et al. | 200/227 |
| 2,450,780 | 10/1948 | Bucklen | 200/226 |
| 2,545,629 | 3/1951 | Posey et al. | 200/227 |
| 2,570,095 | 10/1951 | Bucklen, III et al. | 200/227 |
| 2,799,753 | 7/1957 | Ray et al. | 200/222 |
| 2,823,284 | 2/1958 | Lentz et al. | 200/226 |
| 3,474,203 | 10/1969 | Mallatratt | 200/221 |
| 3,983,350 | 9/1976 | Camin | 200/61.47 |
| 4,434,337 | 2/1984 | Becker | 200/220 |
| 4,529,854 | 7/1985 | Johnston | 200/222 |
| 4,572,934 | 2/1986 | Johnston | 200/222 |

*Primary Examiner*—Renee S. Luebke
*Attorney, Agent, or Firm*—George Pappas

[57] ABSTRACT

A mercury tilt switch having a hollow metal housing with opposite open ends. An insulating glass member is disposed at, makes a glass-to-metal compression seal with, and closes, one of the open housing ends. A metal end cap is disposed at, resistance welded to, and sealably closes, the other of the open housing ends. The housing has an outer wall portion defining a single chamber therewithin which extends between the insulating glass member at the one housing end and the metal end cap at the other housing end. At least one electrical electrode is sealably mounted through the insulating glass member and projects from opposite sides thereof to the outside of and into the housing chamber. A quantity of mercury is disposed in the single housing chamber and is flowable between and contactable with the electrode at the one housing end and the metal end cap at the other housing end upon tilting and countertilting of the housing. Further, the housing can include a baffle disposed within the single chamber of the housing generally intermediate of the opposite ends thereof and having a passageway defined therethrough which provides a flow path for the quantity of mercury between the electrode and the end cap so as to increase the required degree of tilting and countertilting of the housing to cause flow of the quantity of mercury therebetween. Preferably, when the baffle is provided, it is a portion of the housing formed integrally with the outer wall portion thereof. A ceramic insert is provided to help prevent arc erosion. A method of manufacturing the switch is provided.

15 Claims, 1 Drawing Sheet

MERCURY TILT SWITCH AND METHOD OF MANUFACTURE

BACKGROUND OF THE INVENTION

1. Field of the Invention

The present invention generally relates to a tilt-type electrical switch and, more particularly, is concerned with a mercury tilt switch having a unique construction and method of manufacture.

2. Description of the Prior Art

Mercury tilt switches are used in a wide variety of applications, such as in thermostats, float controls, solenoids, relays, etc. All of these applications involve initiating an electrical switching action by mechanical movement or tilting of the switch. Specifically, the making or breaking of electrical contact occurs as a result of tilting of the switch which causes a quantity of mercury contained therein to flow from one location to another.

The contact electrodes of the mercury tilt switch are typically a pair of spaced electrodes disposed at one end of a hollow housing of the switch. When the switch housing is composed of electrically conductive material, one of the electrodes can be the switch housing itself and the other an electrode in an assembly received in the one end of the hollow housing fixed in an insulated relationship thereto. The switch is closed and electrical contact made when the switch housing is tilted in such a manner that the quantity of mercury flows toward and collects at the one end of the switch housing where the mercury bridges the spaced electrodes. On the other hand, the switch is opened and electrical contact broken when the switch housing is tilted in such opposite manner that the quantity of mercury flows toward and collects at the opposite end of the switch housing out of contact with at least one of the electrodes.

Representative of the prior art are the mercury tilt switches disclosed in U.S. Pat. Nos. to Staley (2,182,216), Posey et al., (2,545,629), Bucklen III., et al., (2,570,095), Ray et al., (2,799,753), Mallatratt (3,474,203), Camin (3,983,350), Becker (4,434,337) and Johnston (4,529,854 and 4,572,934).

One widely used prior art mercury tilt switch construction, being similar to that shown in the Johnston patents, is illustrated in FIGS. 1 and 2 herein. Basically, the prior art mercury tilt switch 10 of FIG. 1 includes a deep drawn steel cylindrical housing 12 having opposite closed and open ends 14 and 16 respectively. An electrode assembly, generally indicated as 18, is coaxially inserted into and affixed to the open end 16 of the housing 12 so as to close the housing 12 and form a gas tight seal. The electrode assembly 18 includes a one-piece solid electrode 20, an annular glass insulating member 22 sealed about the electrode 20 and a steel weld ring 24 fitted about the glass insulating member 22 and adapted to be affixed, such as by resistance welding, to the open end 16 of the housing 12.

The mercury tilt switch 10 of FIG. 1 has a relatively narrow angle of operation as compared to the switch 10' of FIG. 2. As is well-known, the addition of an apertured baffle member 26 to the switch 10' of FIG. 2 permits switch 10' to have a relatively wide angle of operation in that tilting of the switch 10' can cover a much wider angle than that of switch 10 before sufficient flow of the mercury either into or out of contact with the electrodes will occur. The baffle member 26 is typically electrically conductive and coaxially mounted inside of the housing 12 by an interference fit therewith intermediate of the closed and open ends 14 and 16 thereof. While the housing 12 alone of the switch 10 of FIG. 1 constitutes the other electrode, both the housing 12 and baffle member 26 of the switch 10' of FIG. 2 constitute the other electrode. Baffle member 26 may be non-conductive such that housing 12 alone may serve as the other electrode.

One serious drawback in regard to either the prior art narrow or wide angle switches 10 and 10' relates to the type of glass-to-metal seal employed by both. The seal is ordinarily what is termed a "matched" seal wherein the glass and metal are selected so as to have substantially the same coefficients of expansion over a predetermined range of temperatures. This temperature range, for instance 50 to 600 degrees F., includes the minimum and maximum temperatures normally expected in the operating environment of the switch as well as the maximum temperature expected to be reached during the welding of the electrode assembly 18 in the open end 16 of the switch. However, the matched seal is very fragile and vulnerable to cracking in response to either mechanical shock or heat shock of the welding operation. Thus, it is difficult to produce a high percentage of switches of this prior art construction which have leak-free seals.

What is commonly known as a compression seal has also been utilized with thin-walled housings such as housing 12 of FIGS. 1 and 2. However, to accommodate the compression seal, it has been necessary to provide a heavier annular ring or grommet to contain the high stresses in the glass. This generally increases the size of the mercury switch, as well as the cost. Accordingly, although a generally more rugged compression-type seal may be utilized, the cost thereof, due to the increased cost of a heavy annular ring, makes this type of switch less desirable.

Another drawback in regard to either of the prior art narrow or wide angle switches 10 and 10' relates to the manufacture of "short run" switches or, as more often referred to, the manufacture of a small number of a particular switch generally for very specific uses or for testing purposes. For these short runs, it becomes quite impractical and much too costly to manufacture the deep drawn steel cylindrical housing necessary for switches 10 and 10'. Accordingly, a need exists for a mercury switch and method of construction whereby short run mercury switches can be manufactured in a less costly manner than having to prepare the necessary drawing dies and deep drawing steel cylindrical housings such as those of switches 10 and 10'.

Another mercury tilt switch construction, which differs from the switch construction of FIGS. 1 and 2 herein, is disclosed in the above-cited patent to Ray et al. Referring to the single figure of the Ray et al., patent and the reference numerals used therein, the switch disclosed therein has a hollow steel casing 1 which is open at both ends. One end of the casing 1 is hermetically sealed to a glass insulator 2 through which electrical conductors 5 and 6 extend into the casing 1. A metal end cap 7 is positioned within and is hermetically sealed to the other end of the casing 1. Interposed in spaced relation between the end cap 7 and the insulator 2 is another metal cap 8 which is secured, for example, by pressure fitting, to the inner wall of the casing 1. A mercury pool 9 is contained in the inner chamber of the casing between the insulator 2 and the inner cap 8. The end cap 7 is assembled to the other open end of the casing 1, for example by welding, after the inner cap 8 has been placed in position within the casing 1. Thus, no mercury can come in contact with the end cap 7 during the welding operation and, thus, there is no opportunity for the end cap 7 when heated to contact and react with the mercury which later can cause erratic mercury flow and unreliable switch performance.

However, the switch construction of Ray et al., appears to create more problems than it solves. By requiring the placement of a pressure-fitted inner cap 8 within the casing 1 to keep the mercury away from the outer end cap 7 as the latter is heated for sealing, Ray et al., disadvantageously employ additional steps and need extra components to manufacture their switch and, thus, also substantially increase the cost of the switch. Also, the added length of the casing required to provide the outer chamber between the end cap 7 and inner cap 8 disadvantageously increases the overall size of the switch and cost of the casing material. Further, although the patent to Ray et al., is silent on the exact type of seal provided between the glass insulator 2 and the casing 1, it is believed that at the time period of this patent, it would have been of the above-described matched seal type. Thus, the seal at the interface of the casing 1 and insulator 2 in Ray et al., probably suffers from substantially the same drawbacks as discussed above with respect to the prior art mercury tilt switches of FIGS. 1 and 2 herein.

Consequently, in view of the above-described drawbacks and problems, it is readily apparent that a need still exists for a fresh approach to mercury tilt switch construction which will eliminate such drawbacks and problems without creating new ones in their place.

SUMMARY OF THE INVENTION

The present invention provides a unique mercury tilt switch construction and method of manufacture designed to satisfy the aforementioned needs. The switch construction of the present invention eliminates the effect of the welding operation on the glass seal end of the switch housing by shifting the welding operation to the opposite end of the housing remote from the glass seal end. At the opposite housing end, a metal end cap is resistance welded thereto to close and seal the same wthout heating up portions of the housing near its other end where the glass seal resides and the mercury is temporarily located. This construction feature not only results in reduced cost, it also reduces the possibility of damage to the glass seal. Further, it allows for the use of a more rugged compression-type glass seal as opposed to the fragile matched-type seal or a compression-type seal, without the need of a more expensive and larger annular ring. In essence, the whole housing is machined, sintered, or possibly die cast having an open end shape capable of accommodating a compression-type glass seal in a single step.

Another feature of the unique switch construction of the present invention relates to the way a baffle is fabricated into the switch to increase its operating angle. The baffle is made an integral part of the switch housing rather than as a separate component which must be inserted therein. For example, the switch housing and baffle are fabricated as a machined, sintered, or possibly die cast one-piece part as opposed to a separate deep drawn housing and a separate baffle insert as heretofore. As a result, the construction of the wide angle switch of the present invention is particularly cost effective in "short" production runs, such as are frequently required where a customer needs only a small number of samples of a particular configuration to determine whether the switch suits a particular application.

Accordingly, the present invention, in one form thereof, is directed to a mercury tilt switch having a hollow housing with opposite open ends, an insulating member disposed at, making a seal with, and closing, one of the open ends of the housing and, an end cap disposed at, making a seal with, and closing, the other of the open ends of the housing. The housing defines a single chamber therewithin between the insulating member at the one housing end and the end cap at the other housing end. At least one electrical electrode is sealably mounted through the insulating member and projects from opposite sides thereof to the outside of and into the housing chamber, and a quantity of mercury is disposed in the single housing chamber and is flowable between and contactable with the electrode at the one housing end and the end cap at the other housing end upon tilting and countertilting of the housing.

More particularly, a compression seal is formed between the insulating member and the housing at the one end thereof. Also, the end cap is made of metal as is the housing, and the end cap is resistance welded to the housing at the other end thereof.

Further, the housing includes an outer wall portion extending between the opposite ends of the housing and defining the single chamber. A baffle is disposed within the single chamber of the housing generally intermediate of the opposite ends thereof and has a passageway defined therethrough which provides a flow path for the quantity of mercury between the electrode at the one housing end and the end cap at the other housing end so as to increase the required degree of tilting and countertilting of the housing to cause flow of the quantity of mercury therebetween. Preferably, the baffle is a portion of the housing formed integrally with the outer wall portion theref.

Still further, a ceramic insert is disposed in the single chamber of the housing and surrounds a portion of the electrode to protect the insulating member or glass seal, housing, and baffle from arc erosion. The ceramic insert is in the form of a sleeve embedded in or mounted to the insulating member and surrounding and extending beyond an inner end of the electrode into the single chamber of the housing. The sleeve is tightly received in a groove defined in the baffle portion of the housing which is coaxially aligned and communicates with the passageway such that the quantity of mercury can flow through the passageway and the sleeve into contact with the electrode.

The present invention in one form thereof is also directed to a method of manufacturing a mercury tilt switch including the steps of: at one end of a pair of opposite open ends of a hollow housing, providing a compression seal between the one housing end and an insulating glass member having an electrode disposed therein to partially close a single chamber defined in the housing between the opposite ends thereof; placing a quantity of mercury in the partially closed single chamber of the housing; and, at the other end of the pair of opposite open ends of the hollow housing, resistance welding an end cap fitted thereon to the other housing end to fully close the single chamber of the housing.

More particularly, the other open end of the housing is provided with a beveled outer edge or weld projection to facilitate the resistance welding of the end cap thereto. Also, the housing is formed by machinng a metal rod or tube. The rod or tube is machined to provide the housing with integrally-connected outer wall and baffle portions. Further, a ceramic sleeve is installed in the housing along with the insulating glass member.

These and other advantages and attainments of the present invention will become apparent to those skilled in the art upon a reading of the following detailed description when taken in conjunction with the drawings wherein there are shown and described illustrative embodiments of the invention.

BRIEF DESCRIPTION OF THE DRAWINGS

In the course of the following detailed description, reference will be made to the attached drawings wherein.

Corresponding reference characters indicate corresponding parts throughout the several views of the drawings.

DETAILED DESCRIPTION OF THE PREFERRED EMBODIMENTS

Figure 1:
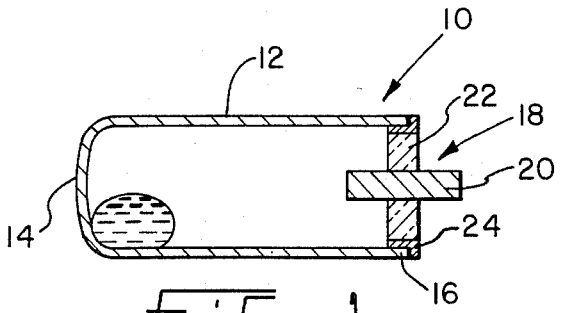
FIG. 1 (PRIOR ART)
FIG. 1 is a longitudinal sectional view of a prior art narrow angle mercury tilt switch which was described earlier in the background section herein.
Figure 2:
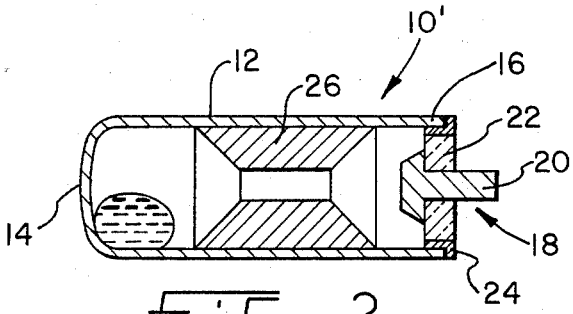
FIG. 2 (PRIOR ART)
FIG. 2 is a longitudinally sectional view of a prior art wide angle mercury tilt switch which was also described earlier in the background section herein.
Figure 3:
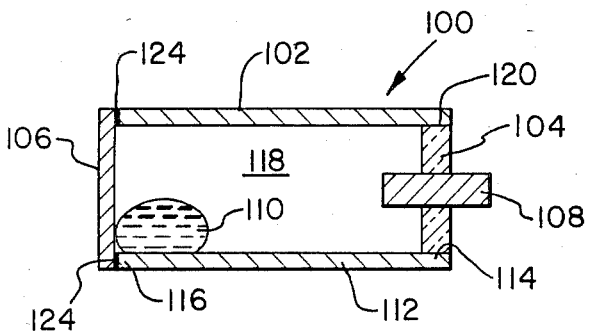
FIG. 3 is a longitudinally sectional view of one embodiment of a narrow angle mercury tilt switch constructed in accordance with the principles of the present invention.

Referring now to the drawings, and particularly to FIG. 3, there is shown a narrow angle mercury tilt switch, generally designated by the numeral 100 and constituting one embodiment of the present invention. In its basic components, the switch 100 includes a hollow housing 102, an insulating member 104, an end cap 106, an electrically-conductive electrode 108 and a quantity of mercury 110.

More particularly, the housing 102 is in the form of a cylindrical wall 112 having opposite open ends 114 and 116 and defining a single chamber 118 extending therebetween. Preferably, the housing 102 is composed of an electrically-conductive, metallic material, such as cold rolled steel. The housing 102 thus provides the other electrode of the switch 100 which is spaced from the one electrode 108 by the insulating member 104. However, it should be understood that a pair of spaced electrodes could be provided in place of the one electrode 108.

The annular-shaped insulating member 104, preferably being made of glass material sealed or molded about the one electrode 108, is fitted within, and makes a glass-to-metal compression seal 120 with, the one open end 114 of the housing. Thus, the one housing end 114 is closed and hermetically sealed by the insulating member 104 and the electrode 108 which extends therethrough. The end cap 106, composed of a metal such as steel, is disposed at, and is resistance welded to the other housing end 116 to hermetically seal and close the same. The single chamber 118 is thus sealed and defined within the housing 102 between the insulating glass member 104 at the one housing end 114 and the metal end cap 106 at the other housing end 116.

The one electrode 108 is sealably mounted through the insulating glass member 104. The electrode 108 is one-piece solid metallic rod which projects bidirectionally from opposite sides of the glass member 104 a short distance outside thereof and also inside into the single housing chamber 118. The quantity of mercury 110 is disposed in the single housing chamber 118 and, upon respectively tilting and countertilting the housing 102, is flowable between and contactable with the electrode 108 and housing wall 112 at the one housing end 114 to close the switch 100. The flow of mercury 110 breaking away from electrode 108 toward the metal end cap 106 opens the switch 100.

By the provision of the housing 102 with both opposite ends 114 and 116 being open and the resistance welding of end cap 106 to the other open housing end 116, a more robust compression seal can be used at the one open housing end 114 to seal the same. The housing 102 can be made of cold rolled steel and can also have a greater wall thickness to accommodate or support a compression seal. In essence, housing 102 is machined, sintered, or die cast having the necessary wall thickness to accommodate a compression-type seal. In a compression seal, it is the compressive force built into the heat treated glass itself which acts outwardly against the steel of the housing end that substantially forms the seal.

Figure 4:
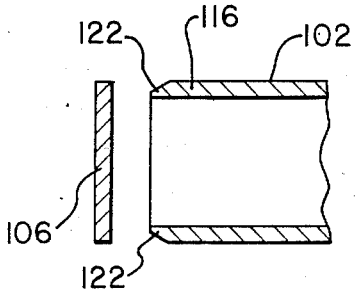
FIG. 4 is a fragmentary exploded longitudinal sectional view of the switch of FIG. 3 showing the configuration of the one open end of the housing of the switch prior to resistance welding of an end cap thereon.

In FIG. 4, it is seen that the other open end 116 of the housing 102 is provided with a continuous beveled outer edge or weld projection 122. The beveled edge 122 facilitates the resistance welding of the end cap 106 thereto by providing the material for the ring of weld 124 which is formed between and connects the periphery of the end cap 106 and the end 116 of the housing 102 together, a seen in FIG. 3. During the resistance welding operation, outer edge or weld projection 122 substantially melts and thereby bonds end cap 106 and end 116 of housing 102 together.

Figure 5:
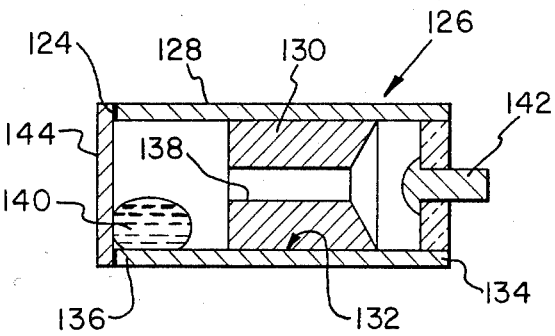
FIG. 5 is a longitudinally sectional view of one embodiment of a wide angle mercury tilt switch constructed in accordance with the principles of the present invention.

Turning now to FIG. 5, another embodiment of a wide angle switch 126 is depicted therein. The housing 128 of switch 126 is substantially identical to that of switch 100 so its construction need not be described again. The major difference between the two switches is that the switch 126 of FIG. 5 contains a baffle 130. The baffle 130 is disposed within the single chamber 132 of the housing 128 generally intermediate of and spaced from the opposite ends 134 and 136 thereof. The baffle 130 is cylindrical in shape and sized to frictionally fit within the chamber 132 of the housing 128. Also, the baffle 130 is preferably composed of a metallic electrically-conductive material where the housing 128 of the switch 126 provides one of its pair of electrodes in order for the baffle to provide an extension of the housing electrode. The baffle 130 has a central passageway 138 defined therethrough which provides a flow path for the quantity of mercury 140 to flow between the electrode 142 or end 134 and the opposite end cap 144 or end 136. The mercury flow path through the passageway 138 of the baffle 130 increases the degree of respective tilting and countertilting required of the housing 128 to cause flow of the mercury 140 between the opposite ends 134 and 136 of the housing 128.

Figure 6:
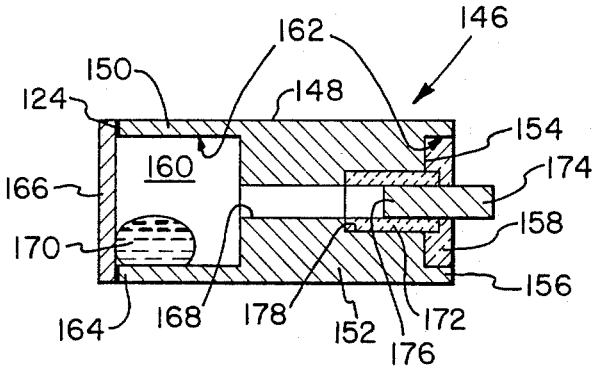
FIG. 6 is a longitudinally sectional view of another embodiment of a wide angle mercury tilt switch constructed in accordance with the principles of the present invention; and, FIG. 7 is a longitudinal sectional view of another embodiment of a generally narrow angle mercury tilt switch constructed in accordance with the principles of the present invention.

Referring now to another embodiment of a wide angle switch, when a baffle is to be provided in a mercury tilt switch, such as shown in FIG. 5, the baffle is preferably integrally formed as a portion of the housing as in FIG. 6 rather than as a separate piece as in FIG. 5 which must be inserted and retained therein by an interference fit or otherwise. In this embodiment, the housing and baffle are constructed similar to that of FIG. 6 wherein switch 146 has an integrally-connected outer wall portion 150 and the baffle portion 152 of the housing 148 is integrally formed therewith in any suitable manner, such as by machining the housing from a metal tube or rod or by sintering or die casting.

In the switch 146 of FIG. 6, the outer wall portion 150 and the baffle portion 152 of the housing 148 together define a recess 154 at one open end 156 of the housing within which an insulating member such as glass 158 is tightly received and compression sealed in the housing outer wall portion 150 or within the inner diameter portion or single housing chamber 162. Also, the outer wall portion 150, the baffle portion 152 of the housing 148 along with single housing chamber 162 define a cavity 160 in the single housing chamber 162 adjacent to the other open end 164 of the housing. The cavity 160 is closed by the end cap 166, communicates with the passageway 168 located in the baffle portion 152, and provides a reservoir for collection of the mercury 170 at the other housing end 164.

Further, the mercury tilt switch 146 has a ceramic insert sleeve 172 for protecting, from arc erosion, baffle portion 152 or passageway 168 and insulating glass member 158. Electrode 174 is sealed or mounted in the insulating glass member 158. The sleeve 172 surrounds and extends beyond an inner end 176 of the electrode 174 and into the single chamber 162 of the housing 148 or recess 154 at end 156. An annular-shaped groove 178 formed in the baffle portion 152 is sized to receive the sleeve 172 in snug-fitting relationship and, further, sleeve 172 is embedded in insulating glass member 158. The groove 178 is defined in the baffle portion 152 in communication, and coaxial alignment, with the passageway 168 such that the mercury 170 can flow through the passageway 168 and the ceramic sleeve 172 and into contact with both the electrode 174 and the baffle portion 152.

Figure 7:
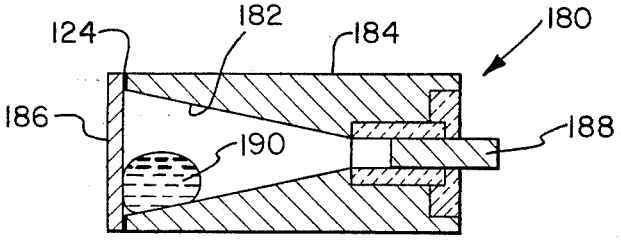

Another embodiment of a narrow angle mercury tilt switch, identified by numeral 180, is shown in FIG. 7. It is substantially identical to the switch 146 of FIG. 6, except for the conical shape of a passageway 182 through its housing 184 which communicates its end cap 186 with its electrode 188 and provides a more direct flow of the mercury 190 therebetween upon tilting and countertilting of the housing.

The mercury tilt switch 100 of FIG. 3 may be manufactured by performance of a combination of steps. First, a housing 102 is provided such as by machining a portion of a steel tube to have a beveled edge or weld projection 122 at one end and the necessary thickness to accommodate a compression seal at the other end thereof. Then, at the one open end 114 of the housing 102 the compression seal 120 is provided thereby fitting or locating the insulating glass member 104 together with the electrode 108 therein. This seal, which is accomplished at elevated temperatures by substantially melting the glass member 104 in position around electrode 108 and within housing 102, partially closes the single chamber 118 defined in the housing 102 between its opposite ends 114 and 116. The desired quantity of mercury 110 is then placed in the partially closed single chamber 118 of the housing 102. Finally, at the other open end 116 of the housing 102, the end cap 106 is resistance welded thereto by generally melting weld projection 122 and bonding end cap 106 to end 116 of housing 102 to fully close the single chamber 118 of the housing 102.

To manufacture the structurally more complex switches 122 with an integral baffle 146 and 180 of FIGS. 5, 6 and 7, in addition to the aforementioned steps, initially each of the metal housings 128, 148 and 184 having the outer wall and baffle portions with the groove, recess and passageway therein must be formed such as by machining the housing from a tubular bar, sintering or die casting. Then, the ceramic sleeve, if one is utilized, is installed in the groove of the respective housing such as by snugly situating the same within the groove and then, the installation of the insulating glass member or the compression seal as described above is completed.

It is thought that the mercury tilt switch of the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

What is claimed is:

1. A mercury tilt switch comprising:

a hollow housing having opposite open ends;

an insulating member disposed at, making a compression seal with, in direct contact with, and closing, one of said open ends of said housing, an end cap disposed at, making a seal with, and closing, the other of said open ends of said housing;

said housing defining a single chamber therewithin between said insulating member at said one housing end and said end cap at said other housing end;

at least one electrical electrode sealably mounted through and in direct contact with said insulating member and projecting from opposite sides thereof to outside of and into said housing chamber; and a quantity of mercury disposed in said single housing chamber and flowable between and contactable with said electrode at said one housing end and with said end cap at said other housing end upon tilting and countertilting of said housing.

2. The switch as recited in claim 1, wherein said end cap is welded to said housing at said other end thereof.

3. The switch as recited in claim 1 further comprising:

a baffle disposed within said single chamber of said housing generally intermediate of said opposite ends thereof and having a passageway defined therethrough which provides a flow path for said quantity of mercury between said electrode at said one housing end and said end cap at said other housing end so as to increase the required degree of tilting and countertilting of said housing to cause flow of said quantity of mercury therebetween.

4. The switch as recited in claim 1, further comprising:

a ceramic insert disposed in said single chamber of said housing and surrounding a portion of said electrode to protect said insulating member and said housing from arc erosion.

5. The switch as recited in claim 1, wherein said housing includes:

an outer wall portion extending between said opposite ends of said housing and defining said single chamber; and a baffle portion formed integrally with said outer wall portion and extending within said single chamber generally intermediate of said opposie ends of said housing, said baffle portion having a passageway defined therethrough which provides a flow path for said quantity of mercury between said electrode at said one housing end and said end cap at said other housing end so as to increase the required degree of tilting and countertilting of said housing to cause flow of said quantity of mercury therebetween.

6. The switch as recited in claim 5, further comprising:

a ceramic sleeve for protecting said insulating member and said housing from arc erosion being mounted to said insulating member and surrounding and extending beyond an inner end of said electrode into said single chamber of said housing, said sleeve being tightly received in a groove defined in said baffle portion of said housing coaxially aligned, and in communication, with said passageway such that said quantity of mercury can flow through said passageway and said sleeve into contact with said electrode.

7. The switch as recited in claim 5, wherein said outer wall portion and said baffle portion of said housing together define a recess adjacent to said one housing end within which said insulating member is tightly received and compression sealed to said housing outer wall portion.

8. The switch as recited in claim 5, wherein said outer wall portion and said baffle portion of said housing together define a cavity in said single housing chamber adjacent to said other housing end and closed by said end cap, said cavity communicating with said passageway through said baffle portion and providing a reservoir for collection of said quantity of mercury at said other housing end.

9. A mercury tilt switch comprising:

a hollow metal housing having opposite open ends;

an insulating glass member disposed at, making a glass-to-metal compression seal with, in direct contact with, and closing, one of said open ends of said housing;

a metal end cap disposed at, resistance welded to, and sealably closing, the other of said open ends of said housing;

said housing defining a single chamber therewithin between said insulating glass member at said one housing end and said metal end cap at said other housing end;

at least one electrical electrode sealably mounted through and in direct contact with said insulating glass member and projecting from opposite sides thereof to outside of and into said housing chamber; and, a quantity of mercury disposed in said single housing chamber and flowable between and contactable with said electrode at said one housing end and with said metal end cap at said other housing end upon tilting and countertilting of said housing.

10. The switch as recited in claim 9, further comprising:

a baffle disposed within said single chamber of said housing generally intermediate of said opposite ends thereof and having a passageway defined therethrough which provides a flow path for said quantity of mercury between said electrode at said one housing end and said end cap at said other housing end so as to increase the required degree of tilting and countertilting of said housing to cause flow of said quantity of mercury therebetween.

11. The switch as recited in claim 9, further comprising:

a ceramic insert disposed in said single chamber of said housing surrounding a portion of said electrode to protect said insulating glass member and said housing from arc erosion.

12. The switch as recited in claim 9, wherein said housing includes:

an outer wall portion extending between said opposite ends of said housing and defining said single chamber; and a baffle portion formed integrally with said outer wall portion and extending within said single chamber generally intermediate of said opposite ends of said housing, said baffle portion having a passageway defined therethrough providing a flow path for said quantity of mercury between said electrode at said one housing end and said end cap at said other housing end so as to increase the required degree of tilting and countertilting of said housing to cause flow of said quantity of mercury therebetween.

13. The switch as recited in claim 12, further comprising:

a ceramic sleeve for protecting said insulating glass member said housing and said baffle from arc erosion being mounted to said insulating member and surrounding and extending beyond an inner end of said electrode into said single chamber of said housing, said sleeve being tightly received in a groove defined in said baffle portion of said housing in communication, and coaxially aligned, with said passageway such that said quantity of mercury can flow through said passageway and said sleeve into contact with said electrode.

14. The switch as received in claim 12, wherein said outer wall portion and said baffle portion of said housing together define a recess adjacent to said one housing end within which said insulating member is tightly received and compression sealed to said housing outer wall portion.

15. The switch as recited in claim 12, wherein said outer wall portion and said baffle portion of said housing together define a cavity in said single housing chamber adjacent to said other housing end and closed by said end cap, said cavity communicating with said passageway through said baffle portion and providing a reservoir for collection of said quantity of mercury at said other housing end.

* * * * *